US006269979B1

(12) United States Patent
Dumont

(10) Patent No.: US 6,269,979 B1
(45) Date of Patent: Aug. 7, 2001

(54) MULTI-COMPARTMENTED MIXING DISPENSER

(76) Inventor: Charles Dumont, 8725 Collins Ave. Apt. 12E, Miami, FL (US) 33154

( * ) Notice: Subject to any disclaimer, the term of this patent is extended or adjusted under 35 U.S.C. 154(b) by 0 days.

(21) Appl. No.: 09/412,582

(22) Filed: Oct. 5, 1999

(51) Int. Cl.[7] ..... B67D 5/60
(52) U.S. Cl. ..... 222/145.1; 222/129; 222/153.06
(58) Field of Search ..... 222/87, 129, 145.1, 222/153.06, 153.07, 212; 215/DIG. 8

(56) References Cited

U.S. PATENT DOCUMENTS

| | | | | |
|---|---|---|---|---|
| 3,255,926 | * | 6/1966 | Modderno | 222/129 |
| 3,856,138 | * | 12/1974 | Maekawa et al. | 215/DIG. 8 |
| 3,964,643 | * | 6/1976 | Morane et al. | 222/129 |
| 4,693,366 | * | 9/1987 | Goncalves | 215/DIG. 8 |
| 5,127,548 | | 7/1992 | Brunet et al. | 222/80 |
| 5,246,142 | | 9/1993 | DiPalma et al. | 222/129 |
| 5,249,712 | | 10/1993 | Lontrade et al. | 222/189 |
| 5,421,483 | * | 6/1995 | Parise | 222/129 |
| 5,497,913 | | 3/1996 | Baker | 222/102 |
| 5,577,636 | | 11/1996 | Fukuoka et al. | 222/94 |

FOREIGN PATENT DOCUMENTS

| | | | | |
|---|---|---|---|---|
| 3644483 | * | 6/1988 | (DE) | 222/129 |
| 8301936 | * | 6/1983 | (WO) | 222/87 |

* cited by examiner

*Primary Examiner*—Joseph A. Kaufman
(74) *Attorney, Agent, or Firm*—Siemens Patent Services LC

(57) ABSTRACT

A multi-compartmented storage and dispensing container is disclosed. In the preferred embodiment, the larger outer bottle surrounds and is attached to an inner compartment or chamber that, in the preferred embodiment, is a generally cylindrical enclosure having helically oriented scores or striations. This cylindrical inner enclosure is attached at its base to the outer bottle and is engaged and broken open by the closure assembly. The closure assembly consists of a threaded cap attached to an inner enclosure engagement arm. A removable security ring is initially located between the bottom of the threaded cap and the outer bottle shoulder. After this ring is removed, the user tightens the cap all the way down, bringing the inner enclosure engagement arm into contact with anchored cylindrical inner enclosure. As the cap is twisted, the inner enclosure breaks along the scored lines due to the torque, and the material contained within the inner enclosure is released into the outer bottle. The user may then shake or otherwise agitate the outer bottle to mix the different materials together.

8 Claims, 4 Drawing Sheets

MULTI-COMPARTMENTED MIXING DISPENSER

BACKGROUND OF THE INVENTION

1. Field of the Invention

The present invention relates to packaging. More specifically, the invention relates to packaging that is designed to first segregate and then mix dissimilar ingredients within a chamber at a time of the user's choice. Even more specifically, it relates to a package having an inner, frangible container holding a first material and a second outer container surrounding the first container that holds a second material. When the first container is broken open, the user can simply shake the outer container to mix the materials together.

2. Description of the Prior Art

There are many products on the market that have dissimilar ingredients or components that need to be mixed together prior to use. In many cases, there is a window of time subsequent to this mixing in which the product needs to be used. Examples of this type of product are in cosmetics, such as hair coloring or dye, epoxies, glues, resins and the like, soaps or lotions with fragrance or antibacterial ingredients, fiber supplements such as Metamucil™, feminine hygiene products, such as douches and the like, pharmaceuticals such as novocaine or penicillin, and various powdered vitamin or food supplements. In all these cases, separate elements or materials need to be mixed together prior to use. The present invention provides a simple, unitary device that allows for storage and transportation of disparate materials and an easy activation routine to mix these elements together at the desired time for dispensing or use. During a search at the U.S. Patent and Trademark Office, a number of relevant patents were uncovered and they are discussed below.

First is U.S. Pat. No. 5,497,913 issued on Mar. 12, 1996 to Denny D. Baker. This describes a mixing bag and method. Unlike the present invention, there is no teaching of a frangible container disposed within another.

Next is U.S. Pat. No. 5,577,636 issued to Hiroki Fukuoka et al. on Nov. 26, 1996. This discloses a multi-tube container with breakable connections and is clearly dissimilar from the present invention. There is no teaching of the novel interiorly contained and anchored frangible tube required by the instant invention.

In U.S. Pat. No. 5,249,712 issued on Oct. 5, 1993 to Jean-Pierre Lontrade et al. This is a package for altering the composition of a liquid. A lock chamber sliding in the neck of a bottle allows for the liquid carried inside to be purified and dispensed. This is clearly unlike the present invention by not having any mention of separate material containing chambers for mixing ingredients together at a desired time.

Another patent of interest is U.S. Pat. No. 5,127,548 issued on Jul. 7, 1992 to Michel Brunet et al. This describes a medicinal spray device with two compartments separated by a puncturable membrane. Unlike the present invention, the separating membrane is not broken by applying torque, but is punctured.

Lastly, U.S. Pat. No. 5,246,142 issued to Elio and Josephine DiPalma on Sep. 21, 1993 discloses a device for storing a pair of products separately and subsequently mixing them. Referring to the embodiment described in FIGS. 6, 7, and 8 the differences between DiPalma et al. and the present invention are:

1) In the instant invention, the frangible interiorly contained compartment is permanently anchored to the base of the larger compartment.

2) The novel engagement means between the interior of the cap and the top of the interiorly contained compartment is not taught by DiPalma et al.

None of the above inventions and patents, taken either singly or in combination, is seen to describe the instant invention as claimed.

SUMMARY OF THE INVENTION

The present invention is a multi-compartmented storage and dispensing container. In the preferred embodiment, the larger outer bottle surrounds and is attached to the inner compartment or chamber that is preferably a generally cylindrical enclosure having helically oriented scores or striations. This cylindrical inner enclosure is attached at its base to the outer bottle and is engaged and broken open by the closure assembly. The closure assembly consists of a threaded cap attached to an inner enclosure engagement arm. A removable security ring is initially located between the bottom of the threaded cap and the outer bottle shoulder. After this ring is removed, the user tightens the cap all the way down, bringing the inner enclosure engagement arm into contact with anchored cylindrical inner enclosure. As the cap is twisted, the inner enclosure breaks along the scored lines due to the torque, and the material contained within the inner enclosure is released into the outer bottle. The user may then shake or otherwise agitate the outer bottle to mix the different materials together.

Accordingly, it is a principal object of the invention to provide a multi-compartmented storage and dispensing container that segregates dissimilar materials that then need to be mixed together prior to use.

It is another object of the invention to provide a multi-compartmented storage and dispensing container where the one of the materials to be mixed is contained in an inner compartment anchored to the bottom of a larger outer compartment.

It is a further object of the invention to provide a multi-compartmented storage and dispensing container where the threaded cap of the larger outer container includes a safety strap located between the cap itself and the shoulder of the bottle, to prevent the inadvertent engagement of the inner compartment.

Still another object of the invention is to provide a multi-compartmented storage and dispensing container where, when the safety strap is removed and the threaded cap is screwed down all the way to the shoulder of the outer container, engagement means on the cap transmits torque to the inner compartment, breaking it and releasing the material held therein into the outer container.

An additional object of the invention is to provide a multi-compartmented storage and dispensing container where the inner compartment is cylindrical and frangible, having a helically shaped score or striation running around it.

It is again an object of the invention to provide a multi-compartmented storage and dispensing container where the engagement means between the screw cap and the inner compartment are a series of interlocking gear teeth brought into engagement with one another as the cap is tightened.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
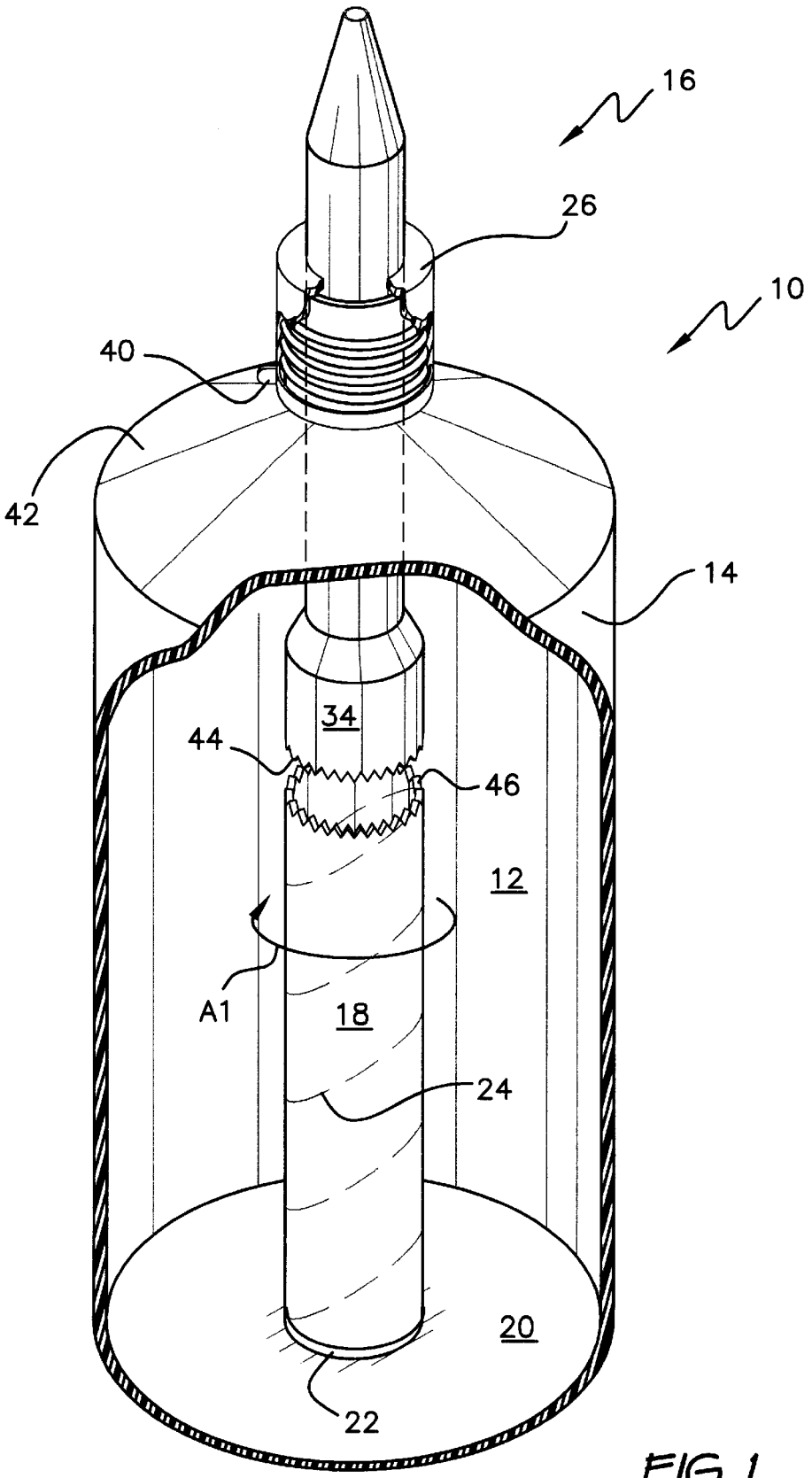
FIG. 1 is a perspective view, partially cut away, showing the first embodiment of the invention. The space between the top of the inner compartment and the threaded cap engagement means has been exaggerated for illustrative purposes.

An embodiment of the present invention is indicated generally at 10 in FIG. 1. Initially, the invention 10 comprises an outer bottle 12 having a outer bottle wall 14 on its surface and including a threaded cap assembly 16. Located interiorly of the outer bottle 12 is the inner compartment 18. This is anchored to the outer bottle floor 20 as indicated at inner compartment anchor point 22. This anchoring could be accomplished by adhesives or by molding the inner compartment 18 in conjunction with the outer bottle 12. Inner compartment 18, in the embodiment described herein, is generally cylindrical in shape and has a helical scoring or striation 24 running about its surface. This scoring or striation 24 serves to make inner compartment 18 frangible, as will be described further below. Inner compartment 18 is completely sealed after being filled with whatever material is desired by the manufacturer.

Figure 2B:
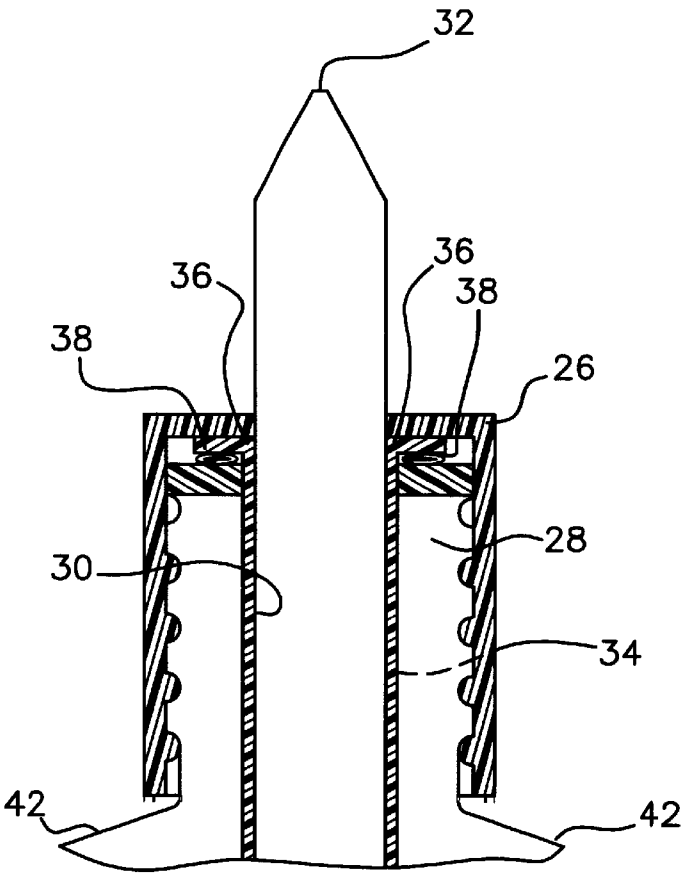
FIG. 2B is a cut away side view of the threaded cap assembly after the inner compartment has been engaged and broken open.
Figure 2A:
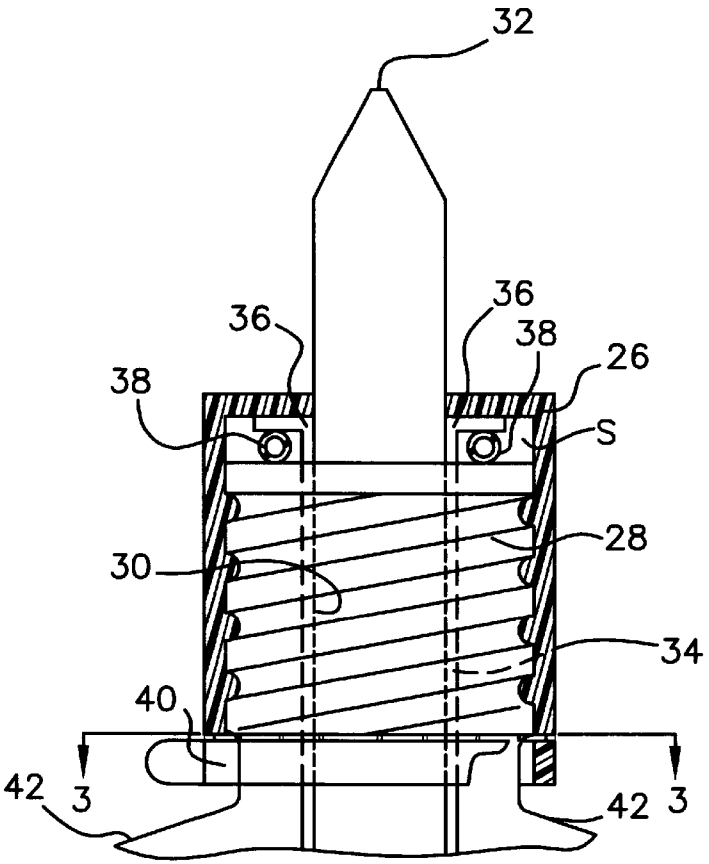
FIG. 2A is a cut away side view of the threaded cap assembly in the pre-dispensing position.

Discussion will now turn to the details of the threaded cap assembly 16. This is most clearly shown in FIGS. 2A and 2B. In FIG. 2A the threaded cap assembly 16 is seen in the storage or pre-dispensing position. In this position the threaded cap 26 is partially threaded on to the threaded bottle mouth 28 leaving a space S above threaded bottle mouth 28. The threaded bottle mouth 28 has within it a nozzle aperture 30 that terminates in a nozzle tip 32. It should be emphasized that the dimensions and configuration of the nozzle aperture and the nozzle tip 30, 32 respectively, are for purposes of illustration only and should not be considered limiting in any way. A number of different types of tips and/or bottle mouths could be utilized without departing from the spirit of the invention. Located withing and passing through the threaded bottle mouth nozzle aperture 30 is the inner compartment engagement portion 34. Above the nozzle aperture 30 proximate the nozzle tip 32, this inner compartment engagement portion terminates in a engagement portion shoulder ring 36 that is attached, by glue or other means, to the threaded cap 26. Of course, as will be described afterwards in the section describing the use of the invention, gluing the engagement portion shoulder ring 36 to the threaded cap 26 is not absolutely necessary. Between the threaded cap 26 and the outer bottle shoulder 42 is the break-away security strap 40. This prevents the inadvertent engagement of the inner compartment 18.

The present invention is designed to be used in a situation where two dissimilar or reactive ingredients need to be mixed together at a predetermined time, such as just before use. Hair coloring, for instance generally has a number of chemicals that need to be mixed together just prior to use. The present invention allows the manufacturer, the retailer, and the user to overcome the inconvenience of packaging, shelving, and mixing these types of products. One unitary package holds all the ingredients and the contents can be mixed together before the package is unsealed for use. The types of products that can be utilized with the instant novel invention are myriad. As mentioned above, other than cosmetic dyes and the like, epoxies, glues, resins, soaps or lotions with fragrance or antibacterial ingredients, fiber supplements such as Metamucil™, feminine hygiene products, such as douches and the like, pharmaceuticals such as novocaine or penicillin, and various powdered vitamin or food supplements could be incorporated into the novel package of the present invention.

Figure 3:
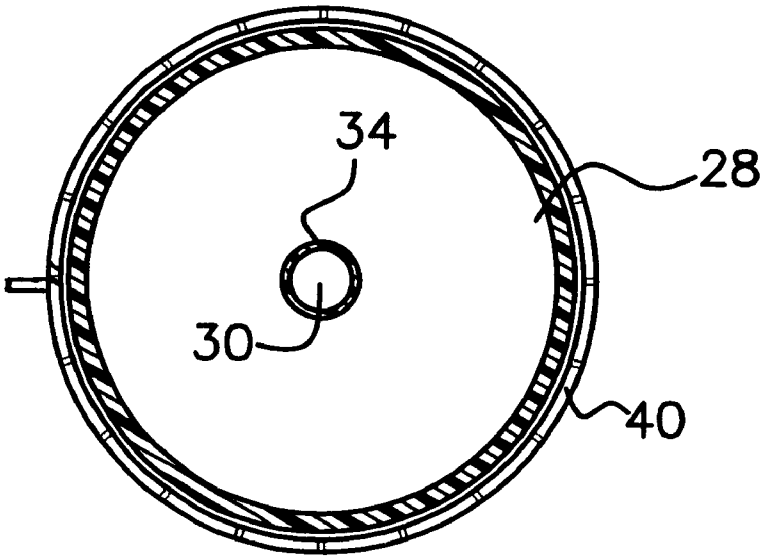
FIG. 3 is a view taken along line 3—3 in FIG. 2A

During the manufacturing process, or immediately afterward, the inner container 18 is filled with a material that is a precursor for the end product. Outer bottle 12 is filled with a separate material. Both of the materials in this embodiment could be liquids, one could be a liquid and the other a solid, or both could be some sort of paired, reactive solids. In any case, the invention provides a convenient single package with no out of package mixing or measuring required. When it is desired to mix the various materials together the user first removes the break away security strip 40. As can be seen in FIG. 3, this strip is generally similar to those found on such common items as milk cartons, soda pop bottles, and the like. The break away security strip is originally in place to prevent the inadvertent tightening down of the threaded cap 26 by physically interposing itself between the cap 26 and the outer bottle shoulder 42. After the strip is removed, the threaded cap may be tightened down completely, to the position seen in FIG. 2B. This, in turn pushes down the engagement portion shoulder ring and the attached inner compartment engagement portion while turning in the direction indicated by directional arrow A1 in FIG. 1. The brings the engagement portion teeth 44 and the inner compartment engagement teeth 46 into contact with one another. As mentioned above in the brief description of the drawings, it should be noted that the distance between the engagement teeth 44, 46 is exaggerated for illustrative purposes. As the inner compartment 18 is then torqued in the direction indicated by directional arrow A1, it breaks along the helical scores or striations 24, releasing the material contained within the inner compartment 18 into the outer bottle 12. It should be emphasized that the interengaging teeth 44, 46 are illustrative of one method of engaging and applying torque to the inner compartment 18. Other designs, such as a plurality of arms engaging in various ways, could also be utilized without departing from the spirit of the invention. Once inner compartment 18 has been broken open and the materials are in contact with one another, the user may shake the bottle 12 to thoroughly mix the dissimilar materials together. The user then can decant the resulting mixture through the nozzle aperture 30 and nozzle tip 32. Note that in this embodiment of the invention, the inner compartment engagement portion 34 is substantially hollow to allow the passage of the resulting mixture to the nozzle 32.

Figure 4:
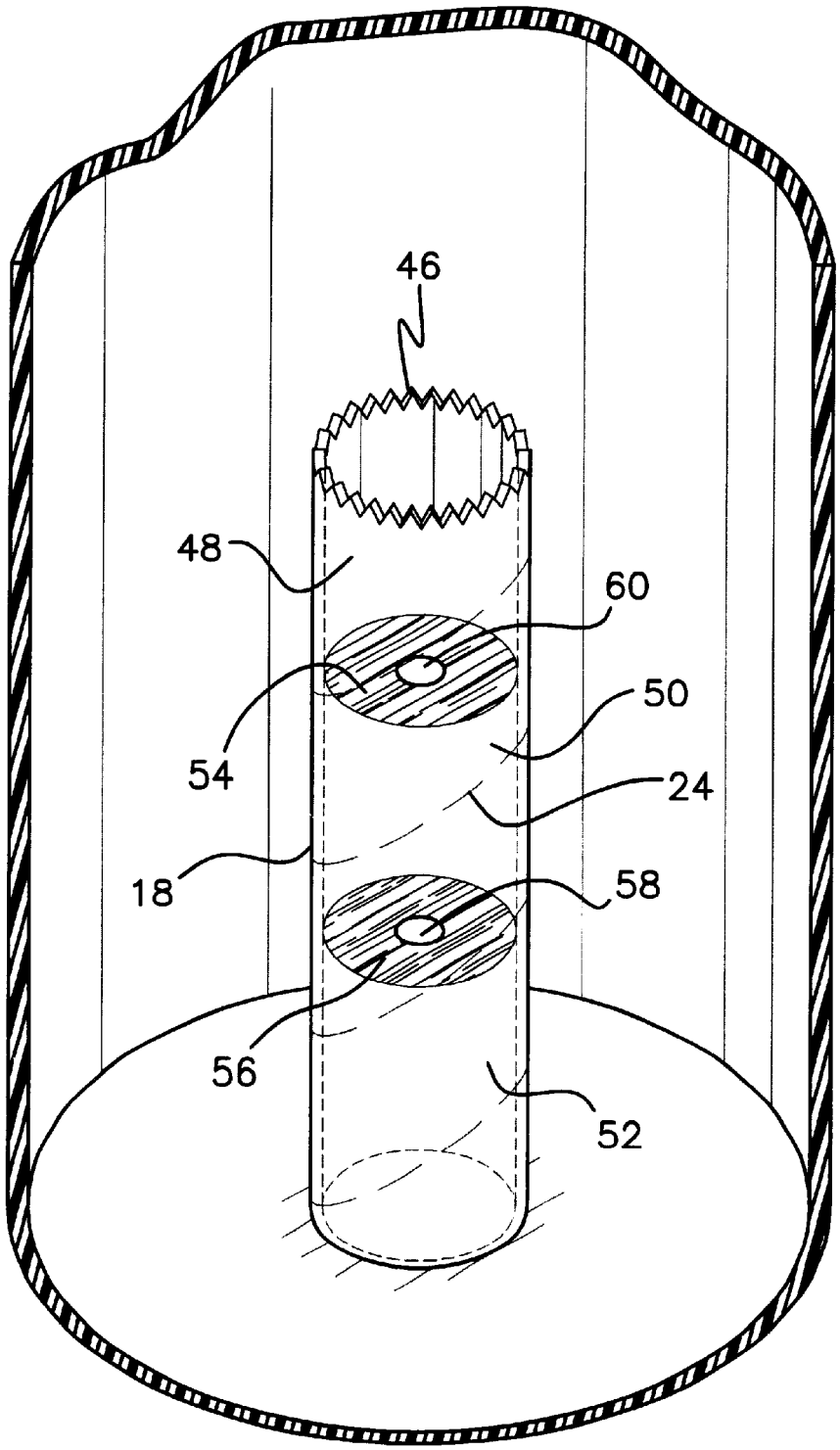
FIG. 4 is a partial cut away perspective view of a second embodiment of the invention wherein the inner compartment itself includes multiple chambers for dispensing more than one ingredient into the outer bottle.

Turning to FIG. 4, a second embodiment of the present invention is disclosed. In this embodiment, the inner compartment 18 is divided into three sections 48, 50, and 52 separated by a pair of dividers 54 and 56. This allows the inner compartment 18 to have three separate different materials or ingredients to be released into outer bottle 12. It should be understood that any number of separate compartments as seen in FIG. 4 could be provided by simply adding and subtracting the dividers. The multiple sections in inner compartment 18 could be filled in turn by an automated process that would fill, for example, section 52 and then plug the fill hole 58. Then section 50 would be filled and fill hole 60 would be sealed. Section 48 would then be loaded and the inner compartment 18 is sealed as usual.

It is to be understood that the present invention is not limited to the embodiments described above, but encompasses any and all embodiments within the scope of the following claims.

I claim:

1. A multi-compartmented package and dispenser comprising:

an outer bottle having an outer wall and a floor and further including a threaded bottle mouth further including an aperture therethrough;

a threaded bottle cap engageable with said threaded bottle mouth;

an inner compartment anchored to said outer bottle floor, said inner compartment being frangible;

an inner compartment engagement portion extending into said outer bottle and adapted such that when said threaded bottle cap is tightened to the limit of the threaded bottle mouth, said inner compartment portion engages with and applies torque to said inner compartment, thus twisting said frangible inner compartment relative to said outer bottle floor, thereby breaking said inner compartment.

2. The package and dispenser according to claim 1, wherein said inner compartment is generally cylindrical.

3. The package and dispenser according to claim 2 wherein said inner compartment has helical scoring about its outer surface.

4. The package and dispenser according to claim 2 wherein said inner compartment engaging portion extends through said threaded bottle mouth aperture.

5. The package and dispenser according to claim 4 wherein said inner compartment engaging portion is attached to said threaded cap.

6. The package and dispenser according to claim 2, wherein engagement between said inner compartment engagement portion and said inner compartment is provided by interengaging teeth.

7. The package and dispenser according to claim 1, wherein a plurality of separate frangible sections are provided within said inner compartment.

8. A multi-compartmented package and dispenser comprising:

an outer bottle adapted for containing a first material and having an outer wall and a floor and further including a threaded bottle mouth further including an aperture therethrough;

a threaded bottle cap engageable with said threaded bottle mouth;

a frangible inner compartment adapted to contain a second material and being anchored to said outer bottle floor, said second material being isolated from said first material by said frangible inner compartment;

an inner compartment engagement portion extending into said outer bottle and adapted such that when said threaded bottle cap is tightened to the limit of the threaded bottle mouth, said inner compartment portion engages with and applies torque to said inner compartment, thus twisting said frangible inner compartment relative to said outer bottle floor, thereby breaking said inner compartment and allowing intermixing of said first material and said second material.

* * * * *